US009587367B2

(12) United States Patent
Ayers et al.

(10) Patent No.: US 9,587,367 B2
(45) Date of Patent: Mar. 7, 2017

(54) SYNTHETIC GRASS COVER FOR MSE WALLS

(75) Inventors: Michael Ayers, Alpharetta, GA (US); Jose Urrutia, Suwanee, GA (US)

(73) Assignee: CLOSURETURF, LLC, Alpharetta, GA (US)

( * ) Notice: Subject to any disclaimer, the term of this patent is extended or adjusted under 35 U.S.C. 154(b) by 924 days.

(21) Appl. No.: 13/231,264

(22) Filed: Sep. 13, 2011

(65) Prior Publication Data

US 2012/0064262 A1 Mar. 15, 2012

Related U.S. Application Data

(60) Provisional application No. 61/382,314, filed on Sep. 13, 2010.

(51) Int. Cl.
*E02D 29/02* (2006.01)

(52) U.S. Cl.
CPC ..... *E02D 29/0241* (2013.01); *E02D 29/0208* (2013.01); *E02D 29/0225* (2013.01); *D10B 2505/202* (2013.01); *E02D 2300/009* (2013.01); *E02D 2300/0085* (2013.01)

(58) Field of Classification Search
CPC ..... E02D 29/00; E02D 29/02; E02D 29/0225; E02D 29/0241; E02D 2300/0075; E02D 2300/0085; E02D 2300/009; E01C 13/08; D10B 2505/202; Y10S 273/13
USPC ..... 405/302.7, 302.2, 284; 428/17, 85
See application file for complete search history.

(56) References Cited

U.S. PATENT DOCUMENTS

| | | | | |
|---|---|---|---|---|
| 4,946,719 | A | 8/1990 | Dempsey | |
| 5,736,237 | A | 4/1998 | Rhee et al. | |
| 5,788,413 | A | 8/1998 | Peggs | |
| 6,375,546 | B1 * | 4/2002 | Lemieux | 451/38 |
| 6,877,932 | B2 | 4/2005 | Provost | |
| 7,682,105 | B2 | 3/2010 | Ayers et al. | |
| 8,403,597 | B2 * | 3/2013 | Ayers et al. | 405/129.85 |
| 8,585,322 | B2 * | 11/2013 | Ayers et al. | 405/129.85 |
| 2004/0086664 | A1 | 5/2004 | Seaton | |
| 2005/0238433 | A1 | 10/2005 | Daluise | |
| 2006/0045995 | A1 * | 3/2006 | Dipple | 428/17 |
| 2008/0069642 | A1 * | 3/2008 | Ayers et al. | 405/129.85 |

(Continued)

FOREIGN PATENT DOCUMENTS

| | | |
|---|---|---|
| EP | 0318243 | 5/1989 |
| WO | WO0137657 | 5/2001 |

OTHER PUBLICATIONS

International Search Report; Jan. 17, 2012; 10 pages, International Searching Authority of the European Patent Office; PCT Patent Application No. PCT/US2011/051341.

(Continued)

*Primary Examiner* — Cheryl Juska
(74) *Attorney, Agent, or Firm* — Gardner Groff Greenwald & Villanueva, PC

(57) ABSTRACT

A mechanically stabilized earth (MSE) wall and/or synthetic grass cover including alternating layers of granular fills and soil reinforcement geo-grids; a wire wall facing; and a synthetic grass cover for covering the wire wall facing, the synthetic grass comprising a geo-textile backing and a plurality of synthetic grass blades comprising synthetic yarns tufted into the geo-textile backing and having a length and density sufficient to substantially shade the geo-textile backing from solar UV rays.

9 Claims, 3 Drawing Sheets

(56) References Cited

U.S. PATENT DOCUMENTS

Figure 1:
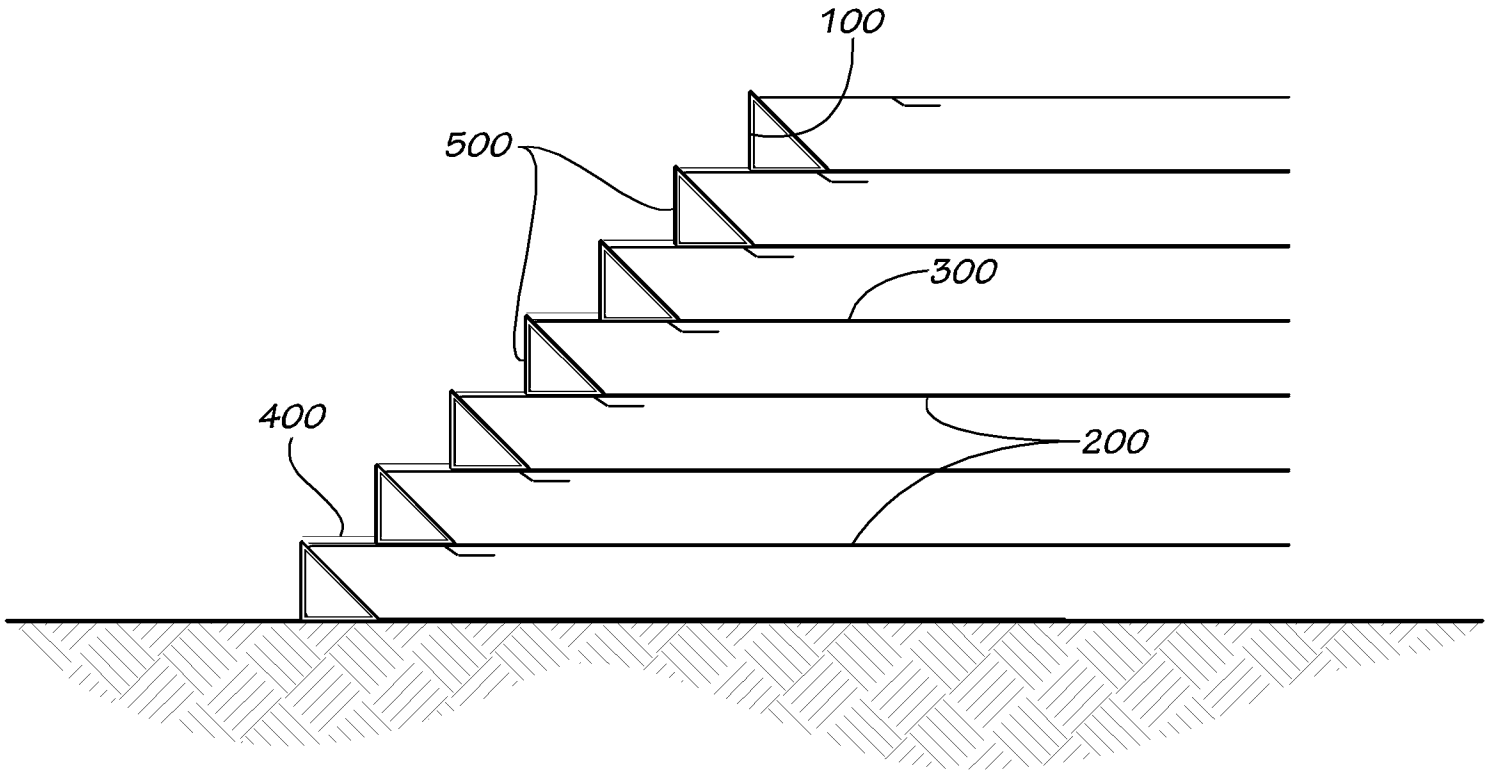
(PRIOR ART) FIG. 1

| | | | | |
|---|---|---|---|---|
| 2008/0193226 | A1 | 8/2008 | Jones et al. | |
| 2012/0063854 | A1* | 3/2012 | Ayers et al. | 405/302.6 |
| 2012/0064263 | A1* | 3/2012 | Ayers et al. | 428/17 |

OTHER PUBLICATIONS

International Preliminary Report on Patentability; Application Serial No. PCT/US2011/051312; Mar. 28, 2013; 6 pages; International Bureau of WIPO, 34, chemin des Colombettes, 1211 Geneva 20, Switzerland.

International Preliminary Report on Patentability; Application Serial No. PCT/US2011/051341; Mar. 28, 2013; 7 pages; International Bureau of WIPO, 34, chemin des Colombettes, 1211 Geneva 20, Switzerland.

* cited by examiner

SYNTHETIC GRASS COVER FOR MSE WALLS

CROSS-REFERENCE TO RELATED APPLICATION

This application claims the priority benefit of U.S. Provisional Patent Application Ser. No. 61/382,314 filed Sep. 13, 2010, which is hereby incorporated herein by reference.

BACKGROUND

Mechanically stabilized earth (MSE) walls have been used in the construction industry for many years now, perhaps since about 1963 or so. The primary component of typical MSE walls comprises alternating layers of granular fills and soil reinforcement geo-grids to which a modular wire wall facing is attached to form the wall face. The wire wall facing is an open grid of wire and forms a sort of wire basket to try to contain the soil somewhat.

The soil reinforcement geo-grids used in the MSE walls sometimes take the form of concrete blocks or other concrete structural elements. Where the use of concrete facing is cost-prohibitive, the soil often is left more or less exposed along the front face thereof. Some limited protection from exposure is often provided by wrapping or cladding the front face of the soil with a geo-textile through which vegetation can grow to provide for a natural look. Typically, when using such a vegetation facing, it has been known in the prior art to construct a stepped wall (stair-stepped) to provide a more natural look in which the vegetation can grow in the flat (horizontal) and vertical sections of the steps.

The geo-textiles typically are synthetic materials and often are used as secondary reinforcement wraps. These synthetic geo-textiles can be damaged by ultra-violet (UV) light over time if the vegetation is not totally established to provide full shade for the geo-textile. The UV damage can cause significant deterioration of the geo-textile over time, which can cause a failure of the MSE wall in that the face of the wall will erode if it rains, degrading or destroying the integrity of the MSE wall.

Artificial grass has been extensively used in sport arenas as well as airport runways and general landscaping. A primary consideration of artificial turf playing fields is the ability of the field to drain. Examples of prior art in synthetic grass drainage are U.S. Pat. Nos. 5,876,745; 6,858,272; 6,877,932 and 6,946,181. However, these applications are generally only for field playing surfaces where the ground is substantially flat and the concern is only with the ability to improve field playing conditions.

SUMMARY

Briefly described, the present invention protects and maintains the integrity of an MSE wall, even in the face of rain, by covering the secondary reinforcement with a synthetic grass cover that provides a UV-resistant cover layer. In this UV-resistant cover layer the tufting size and the length of the pile grass are designed in such a way to drape UV cover protection to shield or shade the secondary reinforcement below. The synthetic grass preferably has a composition of synthetic yarns selected to provide UV protection for many years. Preferably, the synthetic yarns are selected to provide UV protection for more than 50 years.

In a first preferred form, a synthetic grass cover is provided for use with MSE walls. The synthetic grass cover comprises a geo-textile backing and a plurality of synthetic grass blades comprising synthetic yarns tufted into the geo-textile backing and having a length and density sufficient to substantially shade the geo-textile backing from solar UV rays.

Preferably, the synthetic grass blades comprise polyethylene monofilament fibers tufted to have a blade length of between about 1½ inches and 4 inches. More preferably, the synthetic grass blades are tufted to have a blade length of between about 2 inches and 3 inches. Most preferably, the synthetic grass blades are tufted to have a blade length of about 2½ inches.

Optionally, the synthetic grass blades are tufted to have a density of between about 30 ounces/square yard and about 120 ounces/square yard. Also optionally, the synthetic grass blades can be tufted to have a density of between about 50 ounces/square yard and about 80 ounces/square yard.

Preferably, the synthetic grass blades have a thickness of at least about 100 microns.

Optionally, the geo-textile backing can be a single layer backing, a double layer backing, or can have more than two layers. But it is preferred that a single layer or double layer backing be used. Optionally, the backing can be made of woven polypropylene, polyethylene monofilament, or slit film. Other materials can be used as well.

In another preferred form, the present invention comprises a mechanically stabilized earth (MSE) wall including: alternating layers of granular fills and soil reinforcement geo-grids; a wire wall facing; and a synthetic grass cover for covering the wire wall facing, the synthetic grass comprising a geo-textile backing and a plurality of synthetic grass blades comprising synthetic yarns tufted into the geo-textile backing and having a length and density sufficient to substantially shade the geo-textile backing from solar UV rays.

BRIEF DESCRIPTION OF THE DRAWING FIGURES

Figure 1A:
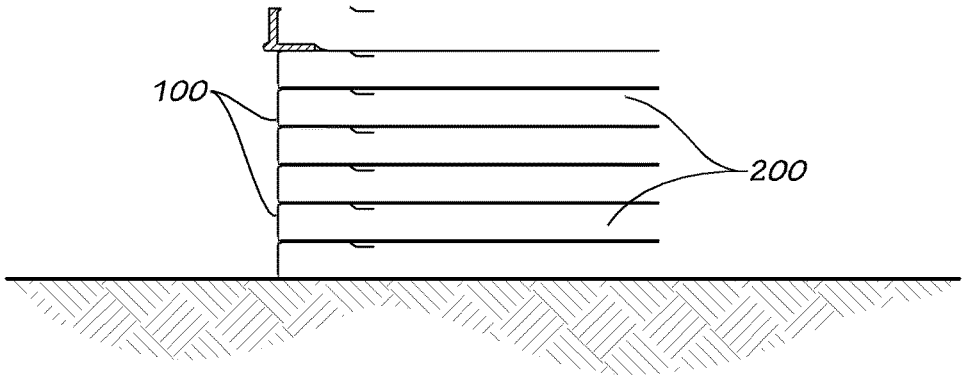
(PRIOR ART) FIG. 1a
Figure 1B:
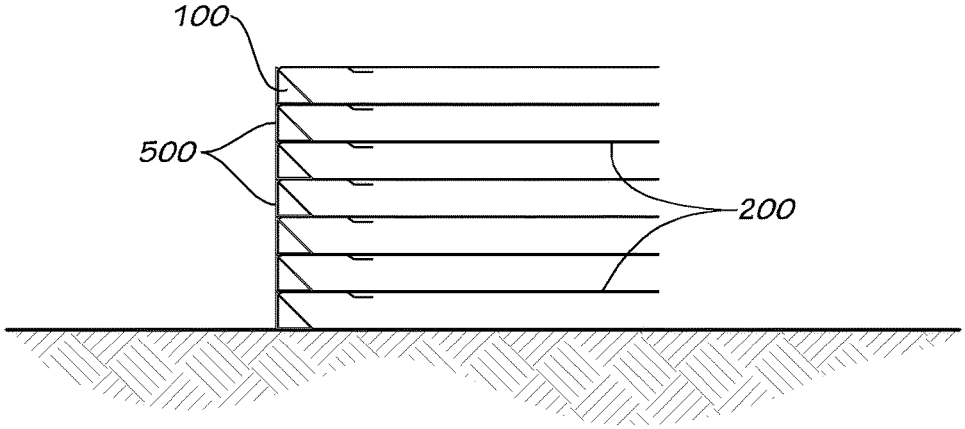
(PRIOR ART) FIG. 1b

FIGS. 1, 1A, and 1B are schematic illustrations of prior art MSE wall constructions.

Figure 2:
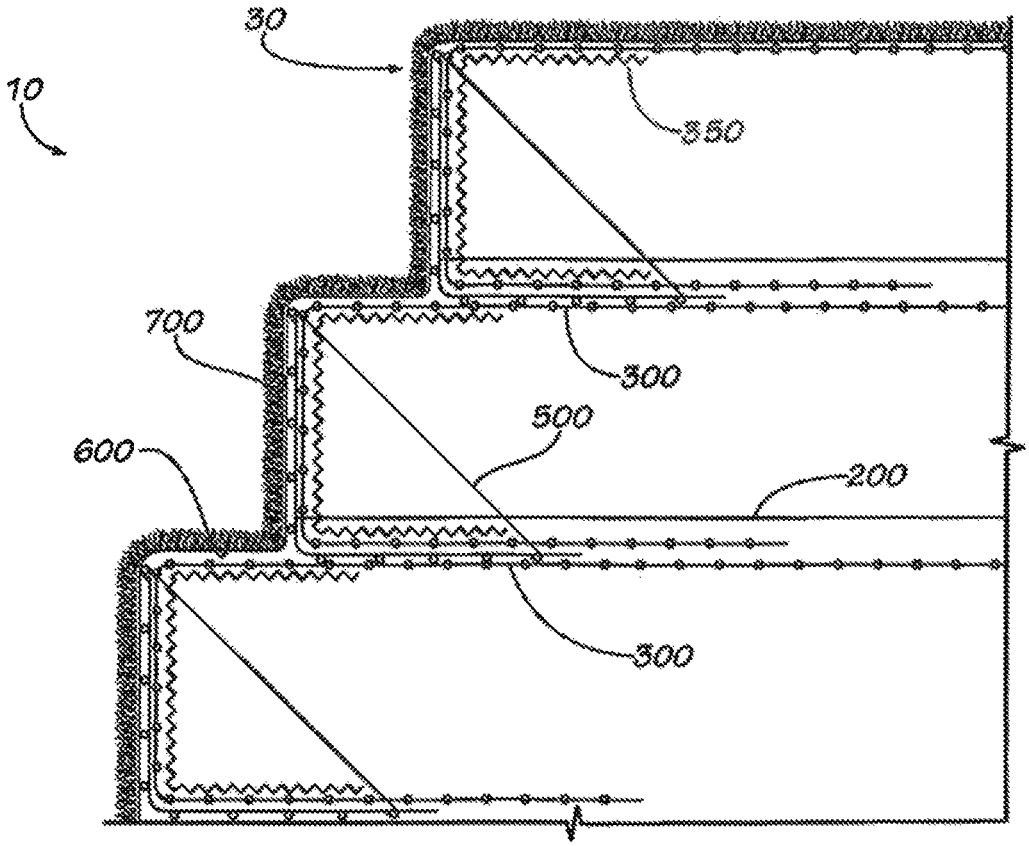

FIG. 2 is a schematic illustration of an MSE wall construction according to the present invention.

DESCRIPTION OF EXAMPLE EMBODIMENTS

Referring now to the drawing figures, wherein like reference numerals represent like parts throughout the several views, FIGS. 1, 1A, and 1B are schematic illustrations of prior art MSE wall constructions. In FIG. 1 the MSE wall construction is shown in a stair-stepped arrangement having a geotextile wrap 100 at the face of the wall, primary geogrid reinforcements 200 in the form of plastic geogrids, and secondary reinforcement geogrids wraps 300. Vegetation indicated at 400 is grown on the horizontal "treads" of the stair-stepped wall to provide some minimal concealment of the geotextile wraps 100 and the wire mesh facing 500.

In FIGS. 1A and 1B the MSE wall construction is shown in a vertical arrangement, again having a geotextile wrap 100 at the face of the wall and primary reinforcements 200 in the form of plastic geogrids. In this vertical construction, no vegetation is provided to conceal the geotextile wraps 100 or the wire mesh facing 500.

FIG. 2 shows a mechanically stabilized earth (MSE) wall 10 according to a preferred form of the invention. The MSE wall 10 optionally includes alternating layers of granular fills and soil reinforcement geo-grids in the form of primary reinforcements 200 comprising plastic geogrids, secondary reinforcement geogrid wraps 300, and structure 350. The MSE wall 10 also includes a wire wall facing 500, here shown following the contour of the stair-stepped wall construction. The MSE wall 10 further includes a synthetic grass cover 30 for covering the wire wall facing. The synthetic grass cover 30 comprises a geo-textile backing 600 and a plurality of synthetic grass blades 700. The blades comprise synthetic yarns tufted into the geo-textile backing 600 and have a length and density sufficient to substantially shade the geo-textile backing 600 from solar UV rays. The synthetic grass (grass-like component) 30 preferably includes polyethylene fibers tufted into one or more woven geo-textile(s) and/or non-woven geo-textile(s). For added strength, an additional mesh backing can be tufted for improved dimensional stability. The polyethylene grass filaments preferably have an extended operational life of at least 30 years and most preferably have an extended operational life of at least 50 years.

Preferably, the synthetic grass blades 700 comprise polyethylene synthetic strand fibers tufted to have a blade length of between about 1½ inches and 4 inches. More preferably, the synthetic grass blades are tufted to have a blade length of between about 2 inches and 3 inches. Most preferably, the synthetic grass blades are tufted to have a blade length of about 2½ inches.

The chemical composition of the synthetic grass blades 700 should be selected to resist exposure to sunlight, which generates heat and contains ultraviolet radiation. The polymer yarns should not become brittle when subjected to low temperatures. The selection of the synthetic grass color and texture should be aesthetically pleasing. While other materials may work well for the grass blades, it is presently believed that polyethylene synthetic fibers work best.

Optionally, the synthetic grass blades (700) are tufted to have a density of between about 30 ounces/square yard and about 120 ounces/square yard. Also optionally, the synthetic grass blades can be tufted to have a density of between about 50 ounces/square yard and about 80 ounces/square yard. The density spec is a measure of density of yarn (grass weight per yard). The tufting is fairly homogeneous. In general, a "loop" is inserted at a gauge spacing to achieve the desired density. Each loop shows as two blades of grass at teach tufted location. Preferably, the synthetic grass blades have a thickness of at least about 100 microns.

Optionally, the geo-textile backing 600 can be a single layer backing, a double layer backing, or can have more than two layers. But it is preferred that a single layer or double layer backing be used. Optionally, the backing can be made of woven or non-woven polypropylene, polyethylene, and or polyethylene monofilament, or slit film. Other materials can be used as well.

The synthetic grass cover 30 can be held in place in a variety of ways, including staking, ballast, tying with string or cord, etc.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A mechanically stabilized earth (MSE) wall comprising:

a plurality of layers stacked in a vertical arrangement, wherein each of the layers comprises granular fills and soil reinforcement geo-grids, and wherein each layer has a top surface, a bottom surface, and an exposed upright surface extending therebetween;

a wire wall facing covering the exposed upright surfaces of the wall layers, the wire wall facing having an inner surface and an outer surface, the inner surface covering the exposed upright surfaces of the wall layers; and a single continuous sheet of synthetic grass covering the outer surface of the wire wall facing and the exposed upright surfaces of vertically adjacent ones of the wall layers, the synthetic grass cover sheet comprising a geo-textile backing and a plurality of synthetic grass blades extending therefrom, the geo-textile backing positioned outwardly of and covering the outer surface of the wire wall facing, the synthetic grass blades comprising synthetic yarns tufted into the geo-textile backing and having a blade length of between about 1-½ inches and 4 inches and a blade density of between about 50 ounces/square yard and about 80 ounces/square yard, wherein the length and density are sufficient to substantially shade the geo-textile backing from solar UV rays.

2. A mechanically stabilized earth wall as claimed in claim 1 wherein the synthetic grass blades are tufted to have the blade length be between about 2 inches and about 3 inches.

3. A mechanically stabilized earth wall as claimed in claim 1 wherein the synthetic grass blades are tufted to have the blade length be about 2-½ inches.

4. A mechanically stabilized earth wall as claimed in claim 1 wherein the geo-textile backing comprises a plurality of sheets.

5. A mechanically stabilized earth wall as claimed in claim 1 wherein the soil reinforcement geo-grids comprise primary reinforcement geo-grids and secondary reinforcement geo-grids, wherein the primary reinforcement geo-grids comprise plastic geo-grids, and wherein the secondary reinforcement geo-grids comprise geo-grid wraps.

6. A mechanically stabilized earth wall as claimed in claim 1 wherein the top and bottom surfaces of each of the layers is generally horizontal and the upright surface of each of the layers is generally vertical.

7. A mechanically stabilized earth wall as claimed in claim 1 wherein the wall layers are arranged in a stair-step arrangement having exposed tread portions of the top surfaces of the layers, wherein the synthetic grass cover sheet covers the exposed tread portions of the top surfaces of the layers.

8. A mechanically stabilized earth wall as claimed in claim 7 wherein the wire wall facing covers the exposed tread portions of the top surfaces of the layers.

9. A mechanically stabilized earth (MSE) wall comprising:

a plurality of layers vertically stacked in a stair-step arrangement, wherein each of the layers comprises granular fills and soil reinforcement geo-grids, wherein the soil reinforcement geo-grids comprise primary reinforcement geo-grids and secondary reinforcement geo-grids, the primary reinforcement geo-grids comprising plastic geo-grids and the secondary reinforcement geo-grids comprising geo-grid wraps, and wherein each layer has a top generally horizontal surface, a bottom generally horizontal surface, and a generally vertical surface extending therebetween, wherein the generally vertical surfaces and tread portions of the top surfaces of the layers are exposed;

a wire wall facing covering the exposed vertical surfaces and the exposed top surface tread portions of the wall layers, the wire wall facing having an inner surface and an outer surface, the inner surface covering the exposed vertical surfaces and the exposed top surface tread portions of the wall layers; and a single continuous sheet of synthetic grass covering the outer surface of the wire wall facing and the exposed vertical surfaces and the exposed top surface tread portions of vertically adjacent ones of the wall layers, the synthetic grass cover sheet comprising a geo-textile backing and a plurality of synthetic grass blades extending therefrom, the geo-textile backing positioned outwardly of and covering the outer surface of the wire wall facing, the synthetic grass blades comprising synthetic yarns tufted into the geo-textile backing and having a blade length of between about 1-½ inches and 4 inches and a blade density of between about 50 ounces/square yard and about 80 ounces/square yard, wherein the length and density are sufficient to substantially shade the geo-textile backing from solar UV rays.

* * * * *